United States Patent [19]

Brede et al.

[11] Patent Number: 4,770,099

[45] Date of Patent: Sep. 13, 1988

[54] PROPELLANT CHARGE IGNITER

[75] Inventors: Uwe Brede, Fürth; Alfred Hörr, Weiherhof, both of Fed. Rep. of Germany

[73] Assignee: Dynamit Nobel AG, Fed. Rep. of Germany

[21] Appl. No.: 102,830

[22] Filed: Dec. 12, 1979

Related U.S. Application Data

[63] Continuation of Ser. No. 834,459, Sep. 19, 1977, abandoned.

[30] Foreign Application Priority Data

Oct. 23, 1976 [DE] Fed. Rep. of Germany ..... 2648137

[51] Int. Cl.[4] ..... F42B 5/08

[52] U.S. Cl. ..... 102/472; 102/202.5; 102/430; 102/431; 102/469; 102/202.14; 102/275.7

[58] Field of Search ..... 102/38 R, 38 CC, 497, 102/45, 46, 202, 215, DIG. 1, 430–433, 380, 469, 470, 472, 202.5–202.14, 275.7; 89/1.701; 149/19.5; 60/39.823, 256

[56] References Cited

U.S. PATENT DOCUMENTS

| | | | |
|---|---|---|---|
| 606,440 | 6/1898 | Bennett | 102/202.9 |
| 1,887,122 | 11/1932 | Duffy | 102/275.7 |
| 2,743,580 | 5/1956 | Loeb, Jr. | 102/202 X |
| 2,973,713 | 3/1961 | Burton | 102/202 |
| 3,062,147 | 11/1962 | Davis et al. | 102/202 |
| 3,182,595 | 5/1965 | Hassmann | 102/202 |
| 3,332,353 | 7/1967 | Burkardt et al. | 102/202 |
| 3,392,673 | 7/1968 | King | 102/202 |
| 3,397,639 | 8/1968 | Alderfer | 102/202 |
| 3,581,662 | 6/1971 | Grebert | 102/202 |
| 3,608,492 | 9/1971 | Mitchell | 102/431 |
| 3,621,781 | 11/1971 | Johnsen | 102/46 |
| 3,696,749 | 10/1972 | Scanlon | 102/38 CC |
| 3,706,277 | 12/1972 | Williard et al. | 102/275.7 |
| 3,726,222 | 4/1973 | White | 102/46 |
| 3,763,782 | 10/1973 | Bendler | 102/28 EB |
| 3,814,017 | 6/1974 | Backstein et al. | 102/215 |
| 3,901,153 | 8/1975 | Brabets | 102/38 CC |
| 4,020,763 | 5/1977 | Iruretagoyena | 102/469 |
| 4,115,167 | 9/1978 | Sbrocca | 149/19.5 |
| 4,172,420 | 10/1979 | Voss et al. | 89/1.701 |
| 4,263,070 | 4/1981 | Price et al. | 102/431 |

FOREIGN PATENT DOCUMENTS

| | | |
|---|---|---|
| 661306 | 5/1938 | Fed. Rep. of Germany . |
| 1062148 | 12/1959 | Fed. Rep. of Germany . |
| 605135 | 7/1948 | United Kingdom . |
| 1452626 | 10/1976 | United Kingdom . |

*Primary Examiner*—Harold J. Tudor

*Attorney, Agent, or Firm*—Antonelli, Terry & Wands

[57] ABSTRACT

A propellant charge igniter for ammunition including an ignition-conducting housing accommodating an electrical ignition system and an initiating charge therein, the housing being formed of an exothermally burning material.

14 Claims, 3 Drawing Sheets

PROPELLANT CHARGE IGNITER

This is a continuation of application Ser. No. 834,459, filed Sept. 19, 1977, now abandoned.

The present invention relates to a propellant charge igniter for ammunition, including an electrical ignition system and an ignitable charge accommodated in an ignition-conducting housing.

Propellant charge igniters are known for cartridge-type ammunition with ignition-conducting tubes of metal to ignite propellant charges made up of loose powder. The ignition-conducting tube with the ignitable charge arranged therein serves for providing a uniform distribution of the ignition flame in the chamber of the cartridge case. The origin of the ignition flame is a pressure-proof screw element with an electrical ignition member in the bottom of the cartridge case, i.e., at one end of the ignition-conducting tube. In case of an ignition which takes place within a minimum amount of time, as is actually desirable, considerable pressure differences can occur between the bottom of the cartridge case and the bottom of the projectile—i.e., in the chamber filled with the propellant charge powder—if the radial exhaust ports of the ignition-conducting tube adjacent to the bottom of the cartridge case are opened first, which frequently occurs. This feature has sometimes undesirable manifestations, such as heavy pressure loads on the granules of the propellant, leading at low temperatures frequently to destruction of the powder granules, which results, in turn, in unexpected rises in gas pressure or in the superposition of reflected pressure waves, likewise connected with rises in gas pressure and causing bulging out of the barrel. For these reasons, it is necessary to prolong the ignition process over a rather long period of time, leading in case of many types of guns to a lenthening of the minimum firing time or in case of automatic firearms to a reduction of the firing frequency.

During the course of the development of more precise weaponry having a higher firing power, the external cartridge volume and the cartridge weight likewise play a decisive part. The firing power can be considerably increased by reducing the weight of the cartridge case, because the time for the unloading of the empty cartridge case can be shortened a great deal. Furthermore, the problem of keeping ammunition in storage and storing of the empty cartridge cases, especially in armored combat cars, can be solved more easily by lightweight and/or smaller cartridges. For this reason, "combustible cartridge cases" have been developed which, in many instances, merely possess a metallic bottom to seal the cartridge chamber with further attempts having been made to abolish even these metallic components.

It is therefore an object of the present invention to provide a propellant charge igniter usable, in particular, in conjunction with combustible cartridge cases and contributing toward an increase in firing power and a decrease in the cartridge weight.

To achieve this object, the present invention provides that the ignition-conducting housing consists of an exothermally burning material. This material can be a substance which is more or less uniform chemically, or it can be a mixture of various substances, this substance or mixture not consuming any energy during combustion but rather supplying energy additionally to the system and thus effecting an increase in the efficiency of the ammunition from the viewpoint of internal ballistics. The exothermally burning material consists preferably at least essentially of a propellant compound. The proportion of the propellant compound is selected in a respective, individual case to be at least so large that the exothermal conversion of the ignition-conducting housing is reliably ensured.

Examples for suitable propellant compounds are nitrocellulose, double-base, triple-base, and multiple-base powders—as known from the propellant chemistry—so-called composite propellants—as they are known from the rocket technology—and/or mixtures of secondary explosives with binders. Suitable as secondary explosives are, for example, octogen (cyclotetramethylenetetramine), especially α-octogen, hexanitrostilbene, triaminoguanidine nitrate, hexanitrodiphenyl ether, or dipicrylsulfone and, as the binders, especially polyester resins, but also polyurethanes or other satisfactorily burning synthetic resins.

According to the present invention, the ignition-conducting housing, which initially serves for distributing the ignition jet during the ignition process uniformly in the charge chamber containing the propellant powder, is subsequently itself consumed in an exothermal reaction. As contrasted to the ignition-conducting housings made of so-called consumable materials, e.g., a synthetic resin such as PVC or also cardboard, which burn more slowly and contribute nothing toward the increase in the efficiency of the internal ballistics but rather themselves consume additionally energy for combustion, the ignition-conducting housing of this invention renders a positive contribution of energy to raise the efficiency of the internal ballistics. Moreover, an ignition-conducting housing made of a propellant compound or the like has the advantage over a metallic ignition-conducting housing that it can be readily shaped, for example, by pressing, so that any geometrical configurations can be imparted to the igniter during its manufacture in a simple manner. Furthermore, there is a high mechanical resistance to bending, vibration, impact, etc.

The initiator charge accommodated in the ignition-conducting housing can be fashioned, for example, in the form of several strands of black powder arranged in parallel to one another, especially a gunpowder low in sulfur, the so-called Benite strands. However, a preferred initiator charge according to this invention is one made from a thermal mixture free of primer substance, also called a hot-particle igniting composition, which conventionally consists at least essentially of an inorganic reducing and oxidizing agent, such as, for example, boron and potassium nitrate. These mixtures, burning without a great evolution of gas and at a high temperature, prove advantageous in view of the lower tamping effect exhibited by the ignition-conducting housing of this invention as compared to the conventional metallic housings. The igniting charge made up of the thermal mixture can be fashioned, for example, in the form of several annular, pressed pills arranged in series in the ignition-conducting housing. The ignition flame emanating from the electrical ignition system can propagate through the central duct formed by these pills. If necesary, the pills can also be joined to the ignition-conducting housing by gluing.

If an additional increase in mechanical rigidity and dimensional stability of the ignition-conducting housing is required in an individual case, then the following reinforcing inserts can be utilized according to the invention, for example:

1. An insert of wire mesh, preferably combustible metals, such as aluminum, magnesium, a pyrometal, boron, etc.

2. Inserts of a nonmetallic type in the form of fabrics or nets, e.g., of carbon (graphite), synthetic resin fibers, etc.

3. Nonwoven mats, preferably of cellulose or nitrocellulose.

4. Noncombustible inserts of up to about 50% by weight, based on the total quantity, of preferably those materials which are decomposed during the pressure buildup in the cartridge, e.g., glass fibers.

5. Combinations of the materials recited in items 1–4 above, in the form of a layered structure.

According to the present invention, a further provision can be made that the ignition-conducting housing is constructed with at least partially porous structure to be able optionally to accelerate an exothermal combustion due to the thus-enlarged surface area. For this purpose, it is possible to incorporate into one or more of the aforementioned materials, such as, for example, nitrocellulose or a double-base powder, a soluble salt such as potassium nitrate, for example, which is again removed by dissolution after the molding of the ignition-conducting housing by extrusion, pressing, or the like, for example, with the aid of water, leaving corresponding cavities.

If the ignition-conducting housing of this invention is made up of two or more parts, these are joined together preferably by gluing. Suitable adhesives are, for example, the glues commercially sold by the company Sichel-Werke, Hannover, Germany under the names "IS 12" and "Sicomet" 50. However, it is likewise possible to utilize polyester resins, polyurethanes, or the like for joining the parts together and optionally also for attaching the ignition-conducting housing in the metallic bottom screw arranged in the bottom of the cartridge case, or also for the joining thereof to other component parts. Those "adhesives" are preferably employed which result in a crosslinking of the parts of the ignition-conducting housing to be joined together, in that they dissolve or swell these parts superficially and the parts then can bond together directly resulting in a homogeneous structure. In the case of an ignition-conducting housing made of nitrocellulose, such an "adhesive" can be, for example, a nitrocellulose lacquer, the solvent proportion of which (e.g., acetone) effects the initial dissolution of the surface. After the evaporation of the solvent, there is then practically no foreign substance at all any longer at the bonding zone.

To avoid or at least reduce the disadvantageous rises in pressure during the ignition step, described hereinabove, and thus likewise to increase the firing power of the weapon, an advantageous further development of the invention provides that the ignition-conducting housing is constructed as an elongated ignition-conducting sleeve, the electrical ignition system being arranged in the central region thereof. The electrical ignition system is constructed so that an ignition impulse is transmitted therefrom into the portion of the ignition-conducting sleeve oriented toward the front, i.e., toward the projectile, as well as into the rearwardly oriented portion. In this connection, the ignition-conducting sleeve is fashioned of two identical partial sleeves. For example, a separate electrical ignition element can be arranged for each partial sleeve. In this arrangement, these elements are disposed between the two partial sleeves and can be triggered simultaneously. However, the use of merely a single ignition element is preferred, having a continuous axial bore and thus making it possible to transmit the ignition impulse also to the side facing away from its ignition bridge and/or its ignition gap. Especially suitable for this purpose are the metal-layer ignition devices described in U.S. Pat. No. 3,763,782. These ignition devices comprise an insulating member of glass or a ceramic material having a continuous bore with the end faces of this member carrying metal-layer contacts and an ignition bridge in part covering the contacts, or optionally also an ignition gap formed between the contacts. By this middle or central ignition of the propellant charge in accordance with this invention, a symmetrical flame propagation is achieved from the center of the charge in the forward direction and toward the rear to the bottom of the cartridge case. The rather long distances to be traversed by the ignition flame are avoided, which distances are necessary in the conventional ignition proceeding from the bottom of the cartridge case and normally requiring a higher pressure so that the entire space occupied by the charge can be axially penetrated. It is thus advantageously possible to reduce the pressure necessary for ignition, i.e., to provide a weaker priming and thus to avoid the pressure waves resulting from the ignition; as a consequence, shorter ignition times can be achieved, permitting a reduction of the minimum firing time and/or an increase in the firing frequency.

The effect of the central ignition according to this invention is the greater, as compared to the conventional bottom ignition method, in accordance with the total length of the ignition-conducting sleeves. The central ignition is, therefore, utilized normally at a total length of more than 100 mm., but it can, in certain cases, also be used, of course, with smaller lengths of the ignition-conducting sleeve, for example, about 50 mm., if this should still prove advantageous. The tubular ignition-conducting sleeve extends generally at least approximately over the entire length of the space occupied by the charge, i.e., from the bottom of the cartridge case to the bottom of the projectile, or at least into close proximity thereof. However, it is also possible to make the ignition-conducting sleeve of a shorter length so that it extends, for example, merely over one-half the axial length of the charge space. Also in case of these lengths, which are relatively small in certain circumstances, a verification must then be obtained in a particular instance whether the symmetrical central ignition of this invention can be advantageously utilized.

The central ignition according to this invention is especially advantageous in conjunction with ignition-conducting sleeves having a material subject to exothermal reaction, since a constructionally favorable arrangement is thus obtained having an excellent ignition characteristic. In this connection, the insulating member of the metal-layer ignition device, instead of being made of glass, a ceramic material, or the like, can then also be made of an exothermally combustible material, such as nitrocellulose, of fiber-reinforced carrier material, such as epoxy resin with a glass fiber fabric, or of other combustible materials. The central ignition can, however, also be utilized in principle in conjunction with the conventional ignition-conducting sleeves of a so-called consumable material, or even of metal, with great advantage, because even here the central ignition method causes a favorable pressure characteristic during the ignition phase and thus permits a reduction of the ignition period. In the case of metallic ignition-conducting sleeves, the at least one lead for the electrical ignition system must, of course, be extended from the bottom of the sleeve to the central ignition system while being electrically insulated, whereas the ignition-conducting sleeve proper can serve as ground connection.

In case of ignition-conducting sleeves of a consumable material or of the preferred exothermally burning material, which simultaneously represent an electrical insulator, it is possible in a very simple way to provide a suitable metallizing of the surface or also any kind of electrical lead arrangement for contacting the ignition system.

In order to metallize the combustible components, a great variety of processes can be employed, such as screen printing, gluing procedures, electroplating methods, etc. With a suitable selection of the contact materials and with an application in very thin layers, the metallic conductor paths will be combusted. Typical conductor path materials are copper, a pyrometal, aluminum, silver, gold, silver-palladium alloys, or the like, for example, in the form of foils and/or screen-printing pastes and/or electrodeposits.

According to a further feature of the present invention, the electric lead for the ignition system is extended from the bottom of the cartridge case over at least substantially the entire length of the ignition-conducting sleeve, i.e., not only over its rear part but also over its forward part. The lead thus extends practially from the bottom of the cartridge case to the front end of the ignition-conducting housing and back again, and the ignition system can be inserted in the starting portion of the lead or in the return portion of the lead. Extending the lead also over the forward part of the ignition-conducting sleeve entails the advantage that malfunctions during firing, i.e., delayed ignitions, cannot occur in case of a possible previous mechancial destruction of the ignition-conducting sleeve, independently of the fact whether such destruction occurs in the rearward or forward part, since the electric lead is also interrupted in both parts and thus the ignition system can no longer be triggered. This effect is present, in particular, in the aforementioned metallic conductor paths in very thin layers which are directly applied to the electrically insulating ignition-conducting sleeve. Such safety with respect to malfunction due to a possible mechanical destruction of the ignition-conducting housing is of very great importance under practical conditions. The provision of the lead also in the front part of the ignition-conducting sleeve furthermore has the advantage that both parts can be fashioned to be identical, whereby manufacture and assembly are simplified.

According to a further feature of the present invention, the central ignition system is disposed in a collar-type connecting tube extending with its two ends over the two parts of the ignition-conducting sleeve within a certain region and connected to this region with the parts, the connection being effected preferably by gluing.

To improve the so-called "first hit probability", electronic procedures are employed to correct the firing or range table wherein the changes of the barrel transmit time and the muzzle velocity are taken into account in dependence on the propellant temperature which is measured. Furthermore, electronic processes are utilized to automatically recognize the type of ammunition, e.g., ammunition with impact projectiles, ammunition with antitank warheads, and the like, to exclude any errors in using the wrong firing table or an incorrect calculating program in the fire-control computer of the weapon. Thermometer probes and electronic components, such as diodes, capacitors, resistors, etc. are required for the various electronic processes, which components are described with regard to their function, for example, in U.S. Pat. No. 3,814,017.

To accommodate such electric components also in the propellant charge igniter of this invention so that the electrical leads required in the propellant charge igniter are maximally simple and as short as possible, and moreover so that the electric components do not cause damage to the weapon during the ignition process, a further feature of the invention provides for arrangement of the electric components at the ignition system in the central zone of the ignition-conducting sleeve and for connection of these components to the ignition system via electric conductors. The substantial advantage inherent in this arrangement of the electric components in the region of the central ignition device is the complete destruction of the components made of a ceramic material, glass, a synthetic resin, silicon crystals, metallic connecting wires, etc., taking place due to the very high pressure and the very high temperature present at this location. This destruction is of extraordinary importance, so that there are no rather large particles left which could damage the barrel of the weapon.

To accommodate the electric components, it is possible according to this invention to provide adapters of a combustible material, comprising recesses to receive the electric components and being glued, for example, to the end face of the block constituting the ignition system.

According to another feature of this invention, it can be advantageous with a view toward compensating for possible changes in the length of the propellant charge igniter, the size of which depends on the materials employed and on the temperature range in which the propellant charge igniter is to be deployed, to effect the electric coupling via a sprung contact pin inserted, so that it is electrically insulated, in the bottom screw of the bottom of the cartridge case. The contact pin is resiliently displaceable in the axial direction, but constantly presses against the electric lead for the ignition system provided at the ignition-conducting housing.

If a high mechanical pressure resistance of the bottom screw is required of up to, for example, 7,000 to 8,000 bar, it is furthermore advantageous to provide the bottom screw according to this invention with a separate, elastically expandable sealing element which, under the action of the gas pressure, contacts with an obturating effect the adjacent walls of the bottom screws.

These and further objects, features and advantages of the present invention will become more obvious from the following description when taken in connection with the accompanying drawings which show, for purposes of illustration only, several embodiments in accordance with the present invention, and wherein FIG. 1 is a schematic longitudinal sectional view through a propellant charge igniter in accordance with the present invention:

Figure 1:
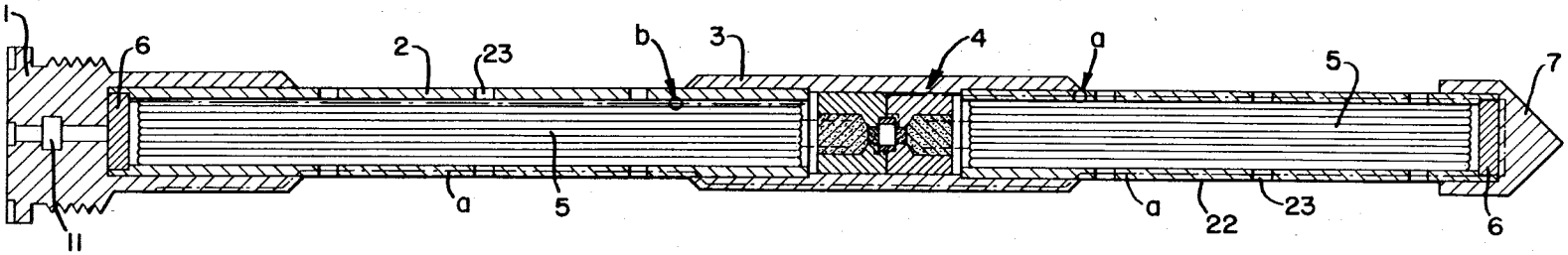

Referring now to the drawings wherein like parts are utilized to designate like parts throughout the several views, there is shown in FIG. 1 a propellant charge igniter having a metallic bottom screw 1 which is resistant to high pressure and is threaded into the bottom of the cartridge case. A pressure-proof, electrically insulated central contact 11 is arranged in the bottom screw 1 and is connected to the electrical lead for the ignition system whereas the bottom screw 1 is utilized as the ground pole for the ignition system.

A rear section 2 of a tubular ignition-conducting sleeve is inserted in the bottom screw 1. The length of this rear section corresponds approximately to half the length of the propellant charge igniter. The ignition-conducting sleeve is also provided with a forward section 22 which is coupled to the rear section by a collet-like connecting tube 3 overlapping the two sections 2 and 22 in the manner of a collet along a respective portion of its length. An ignition system 4 is disposed in the center of the connecting tube 3.

The front end of section 22 of the ignition-conducting sleeve is sealed by a cap 7 which tapers to a point on the outside and a cover disk 6 is arranged underneath this cap. The conical cap 7 advantageously ensures that the propellant charge powder is not compacted between the propellant charge igniter and the bottom of the projectile to an undesirable extent during the insertion of the projectile in the cartridge case when the propellant charge igniter has been threadedly mounted and the propellant charge powder has been inserted. That is, due to the provision of this cap, the individual propellant grains can slide along the inclined sides of the cap and thus are not compacted. This danger of compacting and possibly destruction exists particularly if the propellant charge igniter extends up to or into the close proximity of the bottom of the projectile, which is the preferred arrangement.

Another sealing disk 6 is arranged in the interior of the bottom screw 1. The parts 2 and 22 of the ignition-conducting sleeve are each filled with a primer charge 5 and include longitudinally extending electric conductor paths a and b, the conductor path a being connected to the bottom screw 1 as the ground pole, and the conductor path b being connected to the center pole 11 by being clamped, for example, between the rearward cover disk 6 and the center pole 11. The conductor paths are made, for example, of the adhesive copper foil No. 1181 produced by the 3M-Company, Neuss, Germany.

The conductor path or lead a passes from the bottom screw 1 along the outside of the section 2 of the ignition-conducting sleeve, over the connecting tube 3, the forward section 22 of the ignition-conducting sleeve up to the front end thereof and, at that point, the lead is turned around between the cap 7 and the forward cover disk 6 and returns along section 22 to the ignition system. The lead is electrically conductively connected to one of the contacts of the ignition system. The other contact of the ignition system is connected to the conductor path or lead b extending on the inside along the rearward section 2 of the ignition-conducting sleeve to the central pole 11. Thus, both conductor paths are connected to the ignition system 4, one of them being extended via a "detour" over the forward, tubular section 22 to prevent the undesirable triggering of the ignition system 4 in case of a possible mechanical destruction of the tubular section 22.

Furthermore, the conductor path extended to the forward end of the propellant charge igniter makes it advantageously possible to establish, if desired, an electrical connection with the projectile, in that the front end of the propellant charge igniter is fashioned as a plug-in connector which engages the bottom of the projectile and connects the conductor path with electric elements of the projectile. In this way, it is then possible, for example, to set a delayed-action fuse in the projectile by feeding corresponding electrical information.

Sections 2 and 22 of the ignition-conducting sleeve are provided with radial perforations 23 for enabling the ignition flame to flash through these perforations into the outer space accommodating the charge. The ignition-conducting sleeve 2, 22, the connecting tube 3, the cap 7, and the sealing disks 6 are preferably made of an exothermally burning material, particularly at least substantially of a propellant, so that they are combusted exothermally during the ignition process. They can be formed, for example, as press-molded components and can contain a binder.

Figure 2:
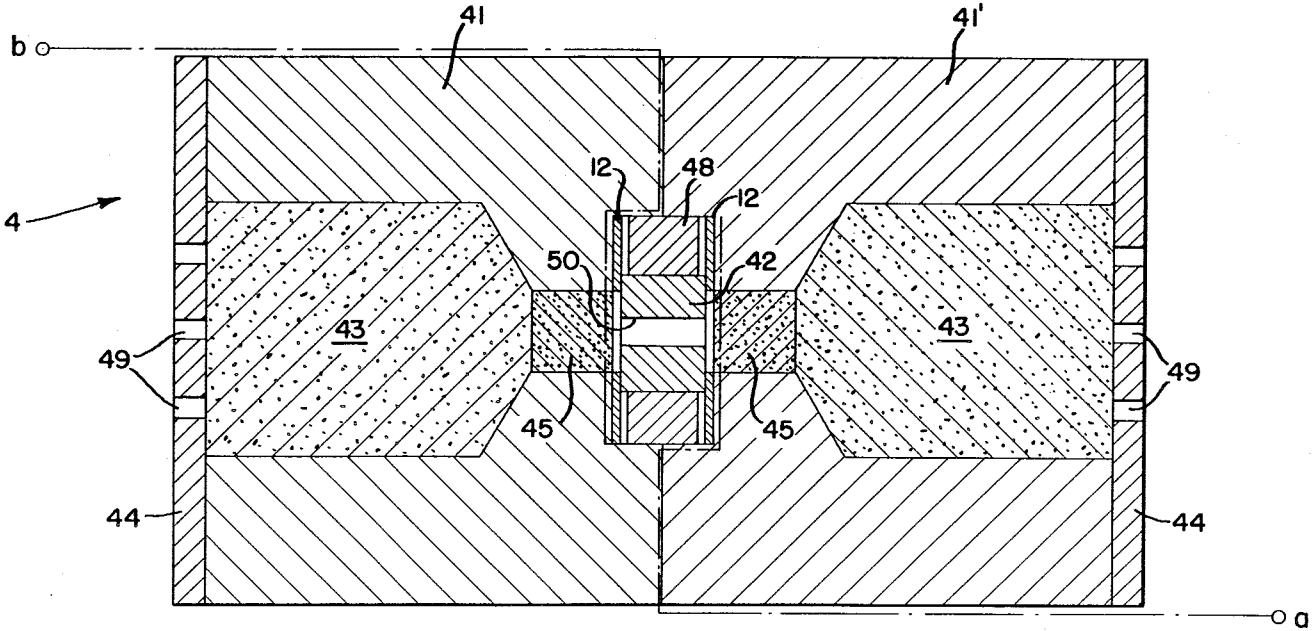
FIG. 2 is, on an enlarged scale, a longitudinal sectional view through the ignition system of the propellant charge igniter according to FIG. 1.

FIG. 2 shows the ignition system 4 on an enlarged scale. This arrangement contains the metal-layer element 42 with an insulating body of glass, a ceramic material, press-molded material, propellant, or the like, which body is provided with metal-layer contacts at the end faces. Between the metal-layer contacts, an ignition bridge is preferably disposed. Such a metal-layer element is described in U.S. Pat. No. 3,763,782. The metal-layer element 42 is in an annular recess formed between two axially opposed ignition element supports 41, 41'. The end faces of the element are in contact with annular disks 12 made, for example, of tin-base bronze, one of which is connected to a lead a and the other of which is connected to lead b. Leads a and b are here extended somewhat differently than in FIG. 1 in the zone of the ignition system 4. The ignition bridge is not visible in the drawing. The metal-layer element 42 is surrounded by an annular centering member 48 for spatially centering the metal-layer element 42 in the interior of the recess formed between the ignition element supports 41, 41'.

Axial bores lead from both end faces of the ignition element supports 41, 41' to the metal-layer element 42. These bores are filled with the pressed-in primary igniting charges 45. Toward their ends, these bores are expanded or flared with the flaring zones being filled with the pressed-in initiator booster charges 43. The expanded or widened bores are finally sealed by cover disks 44 constituting the terminations of the ignition element supports 41, 41' on the end face side and being provided with axial holes 49 in the zone of the charges 43.

The entire central ignition system illustrated in FIG. 2 is fashioned as a compact, symmetrical block, the parts of which are glued or pressed together or firmly joined in some other way. All of the components, except for the metal layers of the metal-layer element 42 and perhaps the insulating body thereof, insofar as it is made of glass, a ceramic material, or the like, consist predominantly of a combustible material, preferably an exothermally reacting material, especially a propellant. The ignition system 4 is arranged in the interior of the connecting tube 3 (FIG. 1) between the end faces of the ignition-conducting sleeve sections 2 and 22.

If an electric voltage is applied between the center pole 11 and the metallic bottom screw 1, a current flows via the conductor path b disposed in the interior of section 2 to one pole of the metal-layer element 42 and on via the ignition bridge to the other side to the conductor path a. The conductor path a is extended over and around the combustible ignitionconducting sleeve section 22 and extends further via the connecting tube 3 and the likewise combustible ignition-conducting sleeve section 2 back to the bottom screw 1.

By the current flow, the ignition bridge disposed on the metal-layer element 2 is ignited. The initiator charges 5 (FIG. 1) are ignited in conjunction with the primary igniting charges 45 in operative connection with one another via the axial bores 50 of the metal-layer element 42, and in conjunction with the ignition booster charges 43. The ignition flames flash immediately or with a delay into the external space accommodating the charge, depending on the dimensioning of the perforations 23 arranged in the ignition-conducting sleeve 2, 22.

The central ignition system 4 is constructed to be symmetrical and depending on the position of the ignition bridge on the metal-layer element 42, the first primary ignition charge 45 to be ignited is that on the right-hand side or that on the left-hand side or the metal-layer element 42. The ignition flame then flashes through the bore 50 thereof and initiates the respectively other primary ignition charge 45. In this way, both ignition booster charges are ignited practically simultaneously, and the ignition flames are propagated symmetrically outward the rear toward the front, emanating from the middle, within the ignition-conducting sleeve sections 2, 22.

Once all of the ignition mixtures consisting of compositions which burn faster than the surrounding, combustible components, have become fully effective, the propellant powder charge which is arranged about the propellant charge igniter in the cartridge case is initiated. The high combustion temperatures and the high pressure then produced during firing have the effect that the entire combustible portion of the propellant charge igniter is completely burned up during the firing period.

The central ignition system of this invention is constructed, in conjunction with the ignition-conducting housing, of a maximum number of identical parts so as to keep the expenditure for manufacture and assembly at a minimum. Another advantage of the feature of initiating ignition directly in the center or approximately in the center of a propellant powder charge is the very rapid initiation with the use of a comparatively small quantity of initiator compositions, whereby an additional reduction in cost is attained while the firing power of the weapon is thereby increased.

Figure 3:
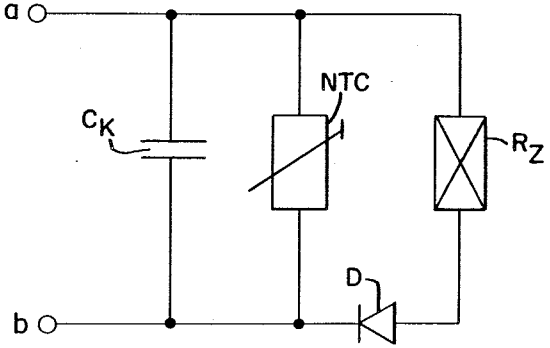
FIG. 3 illustrates a circuit diagram of an electric circuit which can be housed in a propellant charge igniter.

In accordance with the circuit diagram illustrated in FIG. 3, three additional electrical components are provided in addition to the metal-layer element which is electrically characterized by a resistor $R_Z$, namely, an identifying capacitor $C_K$, a temperature sensor NTC, and a diode D. This circuit serves, on the one hand, for the determination of the ammunition identification and for measuring the propellant charge powder temperature, and, on the other hand, for igniting the ignition system $R_Z$. During the measuring phase, a positive d.c. voltage is applied to point b superimposed by an a.c. voltage of a small value. The diode D prevents, in this phase, the triggering of the ignition system $R_Z$. The a.c. voltage is used to determine the impedance resulting from the capacitor $C_K$ and the NTC resistor. The shift of the ohmic resistance value of the NTC resistor in dependence on the temperature changes the real component of the complex impedance value. By means of an evaluating device, the complex impedance value is broken down into the real component and the imaginary component. The temperatue is correlated with the real component, while the ammunition identification is correlated with the imaginary component which is independent of the temperature. For example, if different capacitors $C_K$ are incorporated for each type of ammunition, it is possible, with the same measuring frequency of the a.c. voltage, to differentiate among the various types of ammunition in correspondence with the varying imaginary components.

If ignition is to be effected, a positive d.c. voltage is applied to point a and thus the current flow via the ignition system $R_Z$ is no longer blocked by the diode D. Since the resistance range of the NTC resistor is selected to be larger by several powers of ten than that of the ignition system $R_Z$, the energy consumption evoked by the shunting effect of the NTC resistor does not impair the flawless triggering of the ignition system $R_Z$.

Figure 4:
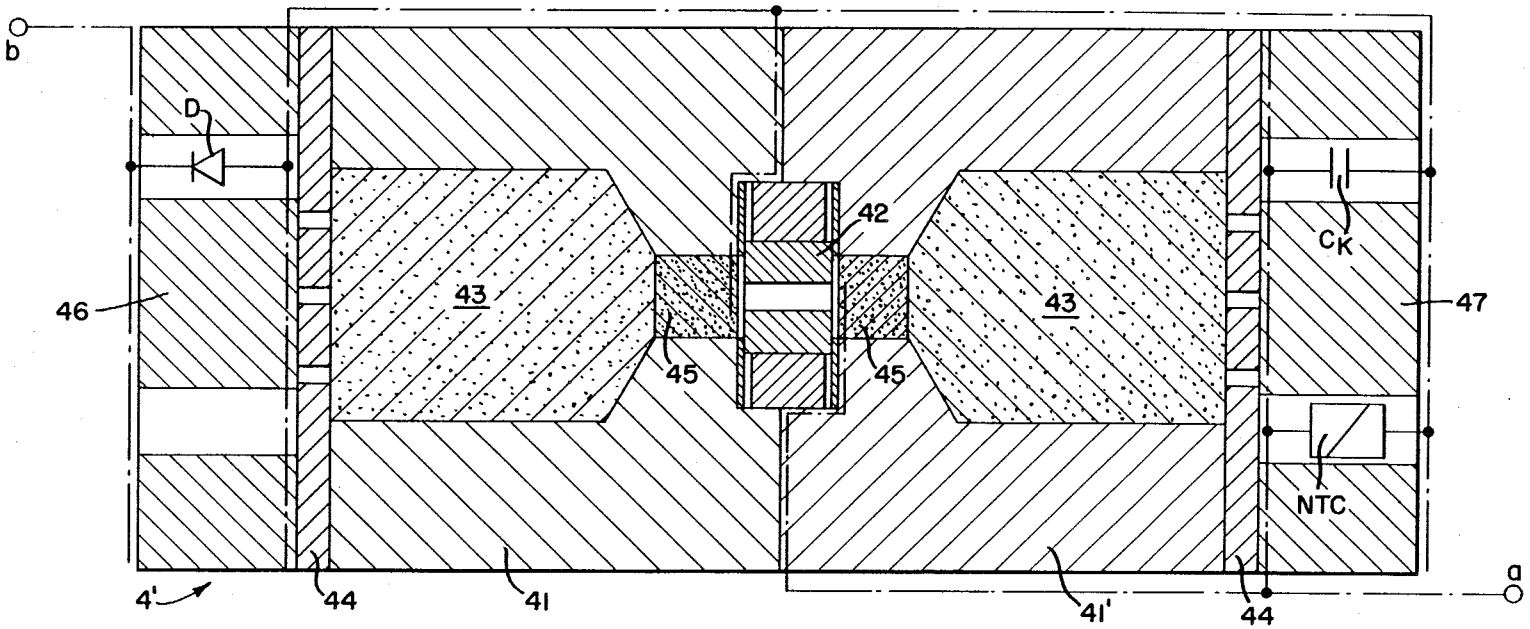
FIG. 4 is a view of an ignition system corresponding to that shown in FIG. 2 with additional electronic adapters for receiving the circuit components illustrated in FIG. 3.

FIG. 4 shows an ignition system 4' substantially similar to the ignition system 4 of FIG. 2, but containing additionally the electrical components of the circuit of FIG. 3. These components are accommodated in plate-shaped adapters 46, 47 attached to the sealing disks 44.

The essential advantage residing in mounting the electrical components in the central ignition system is that the components of a ceramic material, glass, a synthetic resin, or semiconductor material and the metallic lead wires are completely disintegrated due to the very high pressure and the very high temperature produced during ignition. Such disintegration is extraordinarily important in order to ensure that the barrel of the weapon is not damaged by larger particles.

Since all four components are arranged in the longitudinal direction in the central zone of the propellant charge igniter, only two conductor paths a and b are required to connect all of the components. Moreover, since measurement of temperature is most advantageously carried out in the center of the propellant charge, the arrangement of the temperature probe NTC in close proximity to the metal-layer element 42 is extraordinarily advantageous. If the other components, such as the identifying capacitor $C_K$ and the diode D were to be accommodated in the metallic bottom screw 1, a possibility which offers itself initially, then at least three leads would be necessary to the components disposed in the center of the sleeve.

The electronic adapter plates 46 and 47, which are made of a combustible, especially exothermally burning material, constitute the mechanical holders for the electric components. They are provided with longitudinal bores wherein these components are accommodated. It can be seen that only two terminals are required with the leads arranged as illustrated with the components $C_K$, NTC and D completely filling the recesses in the adapter plates 46, 47 in which they are accommodated. The electrical terminals for the components are disposed in the plane of the end faces of adapter plates 46, 47.

In addition to the already discussed advantage of a simpler extension of the electric leads to the central ignition system, FIG. 4 also shows the geometrical symmetry of the components permitting a universal utilization thereof in the form of a module system. If propellant charge igniters without electric components are to be employed, then it is merely necessary to omit the electronic adapter plates 46, 47. This feature results in a considerable simplification during the mass production of various combustible ignition systems and thus in a substantial saving in costs.

Since the mechanical components, in accordance with the invention, consist of energy-yielding combustible material, the entire mechanical bonding can be accomplished by gluing or cementing. This had the advantage that, for example, a genuine bonding of the materials by cross-linking is attained and thus there are practically no mechanically weakened bonding zones. The conductor path technique for the electric connection of the electrically functioning elements must be correspondingly modified in correspondence with the particular bonding technique employed. For example, the electric conductor paths should have a mesh-like structure so that the materials to be joined can crosslink to one another through the perforations in the conductor paths, in conjunction with a suitable press-bonding technique.

Figure 5:
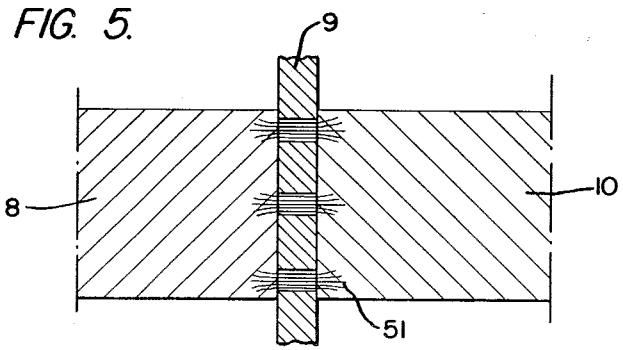
FIG. 5 illustrates, on a greatly enlarged scale, a conductor path enclosed between two combustible elements.

The example in FIG. 5 shows the location of a seam representing the principle of crosslinking during the bonding of two combustible components. The conductor path 9 is encompassed by two combustible elements 8 and 10. Through the mesh openings 51 in the path 9, under strong contact pressure exerted on elements 8 and 10 and with the use of a conductor path 9 having a thickness of between about $2\mu$ and $50\mu$, the adhesive can bond the two elements 8 and 10 together by crosslinking. The bundles of lines shown in the figure are representative of the molecular crosslinking which takes place.

Figure 6:
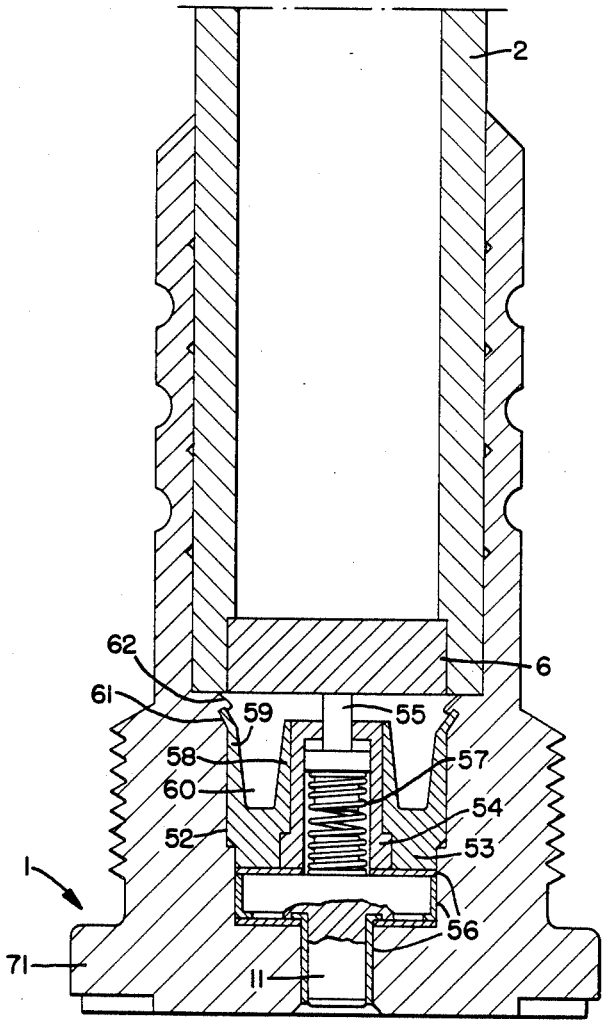
FIG. 6 is a longitudinal sectional view through a bottom screw in accordance with the present invention.

The bottom screw 1 shown in FIG. 6 includes the base element 71 made preferably of brass, which element can be threaded into the metallic bottom of the cartridge case. A recess 52 is disposed in the base element 1 and the pressure-proof center pole 11 of steel, for example, and a sealing element 53 made preferably of brass or also of an elastic steel are housed in this recess. Further, a resilient contact pin 55 is disposed, together with the housing 54, in the sealing element 53, and is electrically insulated from the sealing element. The center pole 11 an the contact pin 55 are electrically insulated with respect to the base element 71 by insulations 56 and/or by the housing 54, which is made of a hard, pressure-proof synthetic resin, for example, laminated plastics. The contact pin 55 rests, via the pretensioning coil spring 57 of steel, spring bronze, or the like and preferably additionally gilded, on the center pole 11 and on the rearward sealing disk 6 of the ignition-conducting sleeve 2 and thus is electrically conductively connected to these components. The pressure-proofness of the bottom screw is assured by the annular collars 58, 59 of the elastically deformable sealing element 53, which rests in the rearward direction of the center pole 11. The inner cylindrical collar 58 rests against the housing 54, while the outer collar 59 contacts the wall of the recess 52 of the base element 71. Between the two collars, the annular pressure space 60 is provided. The forward rim of the outer collar 59 engages form-fittingly into the annuar gap 61 of the recess 52, which is achieved by flanging the annular rim 62 of this recess against the edge of the collar. Due to this pretensioning of the sealing element 53 during assembly, a relatively good sealing action is already obtained with respect to the base element 71. When the gases flow into the pressure space 60 during the initiation of the propellant charge igniter, the very high gas pressure presses the outer collar 59 against the base element 71 and the inner collar 58 against the housing 54, whereby a perfectly obturating seal is attained for the bottom screw which has proven safe up to pressures of 7,000–8,000 bar.

While we have shown and described several embodiments in accordance with the present invention, it is understood that the same is not limited thereto but is susceptible of numerous changes and modifications as known to those skilled in the art and we therefore do no wish to be limited to the details shown and described herein but intend to cover all such changes and modifications as are encompassed by the scope of the appended claims.

What is claimed is:

1. A propellant charge igniter for cartridge-type ammunition comprising an elongated ignition-conducting housing means accommodating therein an electrical ignition system means and an initiating charge disposed on at least one side of the electrical ignition system means, the ignition-conducting housing means being formed of an exothermally burning material containing a secondary explosive and a binder, the ignition-conducting housing means enabling a controlled uniform distribution of an ignition jet to a propellant charge, the ignition-conducting housing means consisting of an exothermally burning material for providing energy upon burning to raise the efficiency of the internal ballistics for the ammunition, the ignition-conducting housing means having openings therein for passage of the ignition jet therethrough, the ignition-conducting housing means being consumed in an exothermal reaction after distributing the ignition jet to the propellant charge.

2. A propellant charge igniter according to claim 1, wherein the ignition-conducting housing means includes reinforcing insert means embedded therein.

3. A propellant charge igniter according to claim 2, wherein the reinforcing insert means is a metallic reinforcing insert.

4. A propellant charge igniter according to claim 3, wherein the metallic reinforcing insert is a wire mesh of a combustible metal.

5. A propellant charge igniter according to claim 2, wherein the reinforcing insert means is a non-metallic reinforcing insert.

6. A propellant charge igniter according to claim 5, wherein the nonmetallic reinforcing insert is in the form of one of a fabric, net, and nonwoven mat.

7. A propellant charge igniter according to claim 1, wherein the cartridge-type ammunition is combustible cartridge case ammunition.

8. A propellant charge igniter for cartridge-type ammunition adapted to be fired from a barrel of a weapon comprising an ignition-conducting housing means formed of an exothermally burning material, the ignition-conducting housing means being arranged for accommodating an electrical ignition system means and an initiating charge therein, the exothermally burning material containing a secondary explosive and a binder, the ignition-conducting housing means enabling a controlled uniform distribution of an ignition jet to a propellant charge and enabling disintegration thereof after the distribution of the ignition jet to the propellant charge to the extent that no residue of the ignition-conducting housing means remains afer firing of the ammunition.

9. A propellant charge igniter according to claim 8, wherein the secondary explosive is octogen, the ignition-conducting housing means being cylindrical and having openings for enabling the passage of the ignition jet therethrough.

10. A propellant charge igniter according to claim 8, wherein the ignition-conducting housing means includes reinforcing insert means embedded therein.

11. A propellant charge igniter according to claim 10, wherein the reinforcing insert means is a metallic reinforcing insert.

12. A propellant charge igniter according to claim 10, wherein the reinforcing insert means is a non-metallic reinforcing insert.

13. A propellant charge igniter according to claim 9, wherein the secondary explosive is $\alpha$-octogen.

14. A propellant charge igniter according to one of claims 8 or 9, wherein the binder is a polyester resin.

* * * * *